US008276524B2

(12) United States Patent
Goode et al.

(10) Patent No.: US 8,276,524 B2
(45) Date of Patent: Oct. 2, 2012

(54) MULTIPLE TIER CENTER SUPPORT CAKE STAND

(75) Inventors: Stephanie Goode, Woodridge, IL (US); Hugh Melling, Woodridge, IL (US); Jeffrey Bull, Woodridge, IL (US)

(73) Assignee: Wilton Industries Inc., Woodridge, IL (US)

( * ) Notice: Subject to any disclaimer, the term of this patent is extended or adjusted under 35 U.S.C. 154(b) by 217 days.

(21) Appl. No.: 12/813,066

(22) Filed: Jun. 10, 2010

(65) Prior Publication Data

US 2011/0303131 A1 Dec. 15, 2011

(51) Int. Cl.
*A47B 11/00* (2006.01)

(52) U.S. Cl. ..... 108/94; 108/101

(58) Field of Classification Search ..... 108/92–94, 108/101, 90, 150, 50.12, 151, 149, 139; 211/85.4, 211/144, 205; 248/158, 159, 188.4; 312/125, 312/135, 305

See application file for complete search history.

(56) References Cited

U.S. PATENT DOCUMENTS

| | | | | |
|---|---|---|---|---|
| 1,155,638 | A | 10/1915 | Bowen | |
| 1,291,366 | A * | 1/1919 | Banks | 312/236 |
| 1,401,057 | A * | 12/1921 | Elliott | 108/101 |
| 160,688 | A | 10/1950 | Brock | |
| 2,680,668 | A * | 6/1954 | Stanfiel et al. | 312/305 |
| 2,890,545 | A * | 6/1959 | Fiddler | 248/188.4 |
| 2,902,174 | A | 9/1959 | Audsley | |
| 2,921,691 | A | 1/1960 | Dembinski | |
| 3,169,496 | A | 2/1965 | Muggli et al. | |
| 3,266,634 | A * | 8/1966 | Tintary | 211/131.1 |
| 3,690,610 | A * | 9/1972 | Peirce et al. | 248/159 |
| 3,831,533 | A * | 8/1974 | Kellogg | 108/64 |
| 3,951,079 | A | 4/1976 | Tolleson | |
| 4,069,772 | A | 1/1978 | Haapala | |
| 4,311,237 | A | 1/1982 | Hayes | |
| 4,383,487 | A * | 5/1983 | Fitzner et al. | 108/27 |
| 5,165,637 | A | 11/1992 | Polley et al. | |
| 5,522,514 | A * | 6/1996 | Robinson | 211/188 |
| 5,617,798 | A | 4/1997 | Lytell | |
| 5,772,050 | A * | 6/1998 | Shih | 211/39 |
| 5,894,944 | A | 4/1999 | Swift | |
| 6,131,523 | A | 10/2000 | Crowley | |
| 6,374,755 | B1 | 4/2002 | Haase et al. | |
| 6,520,352 | B2 | 2/2003 | Mondragon et al. | |
| 6,631,804 | B2 * | 10/2003 | Wong | 206/526 |
| 6,688,239 | B1 | 2/2004 | Pettini et al. | |
| 7,213,951 | B2 * | 5/2007 | Cowan | 362/431 |
| 2002/0074304 | A1 | 6/2002 | Hardy | |

FOREIGN PATENT DOCUMENTS

CH 692441 * 6/2002

OTHER PUBLICATIONS

Wilton Cake Stand Design No. 304-7915, 1 page, for sale around 1972.

* cited by examiner

*Primary Examiner* — Janet M Wilkens
(74) *Attorney, Agent, or Firm* — Foley & Lardner LLP

(57) ABSTRACT

A multiple tier center support stand that includes a plurality of plates each being configured to be associated with a mechanical fastener and a plurality of posts each being configured to be associated with a mechanical fastener. The mechanical fastener is arranged on at least one of the plurality of plates and the plurality of posts in order to vertically arrange the plurality of plates and the plurality of posts. At least one of the plurality of plates is configured to be disassembled in at least two pieces.

17 Claims, 10 Drawing Sheets

MULTIPLE TIER CENTER SUPPORT CAKE STAND

BACKGROUND OF THE INVENTION

1. Field of the Invention

The invention is directed to a foodstuffs display stand and, more particularly, to a foodstuffs display stand that is customizable and also has the ability to be disassembled into a compact arrangement.

2. Related Art

Many display stands for foodstuffs have various configurations that are not typically customizable. In this regard, these display stands typically will have set designs or designs that do not create a sturdy display stand. Moreover, typical foodstuffs display stands do not have the ability to be easily disassembled and placed into a compact arrangement for storage and transport. The result is that a user of the display stand is limited in their ability to create a customizable display stand that is attractive and will display the desired arrangement of foodstuffs such as cakes and cupcakes in the desired manner. Moreover when not used, such display stands take up a great deal of storage space, are not easily transported, and therefore are likely less desirable.

Accordingly, there is a need for a display stand for foodstuffs that is easily customizable, attractive, sturdy and configured to be easily placed into an arrangement that saves space.

SUMMARY OF THE INVENTION

The invention meets the foregoing need and allows for a display that is easily customizable, attractive, strong and that may be easily stored in a compact arrangement and other advantages apparent from the discussion herein.

Accordingly, in one aspect of the invention a multiple tier center support stand includes a plurality of plates each being configured to be associated with a mechanical fastener, and a plurality of posts each being configured to be associated with a mechanical fastener, the mechanical fastener being arranged on at least one of the plurality of plates and the plurality of posts in order to vertically arrange the plurality of plates and the plurality of posts, where at least one of the plurality of plates is configured to be disassembled in at least two pieces.

According to another aspect of the invention, a multiple tier center support stand includes a plurality of plates each being configured with an aperture to interact with a mechanical fastener, and a plurality of posts each being configured to be associated with a mechanical fastener, the mechanical fastener being arranged on at least one of the plurality of plates and the plurality of posts in order to vertically arrange the plurality of plates and the plurality of posts, where at least one of the plurality of plates is configured to be disassembled in at least two pieces.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
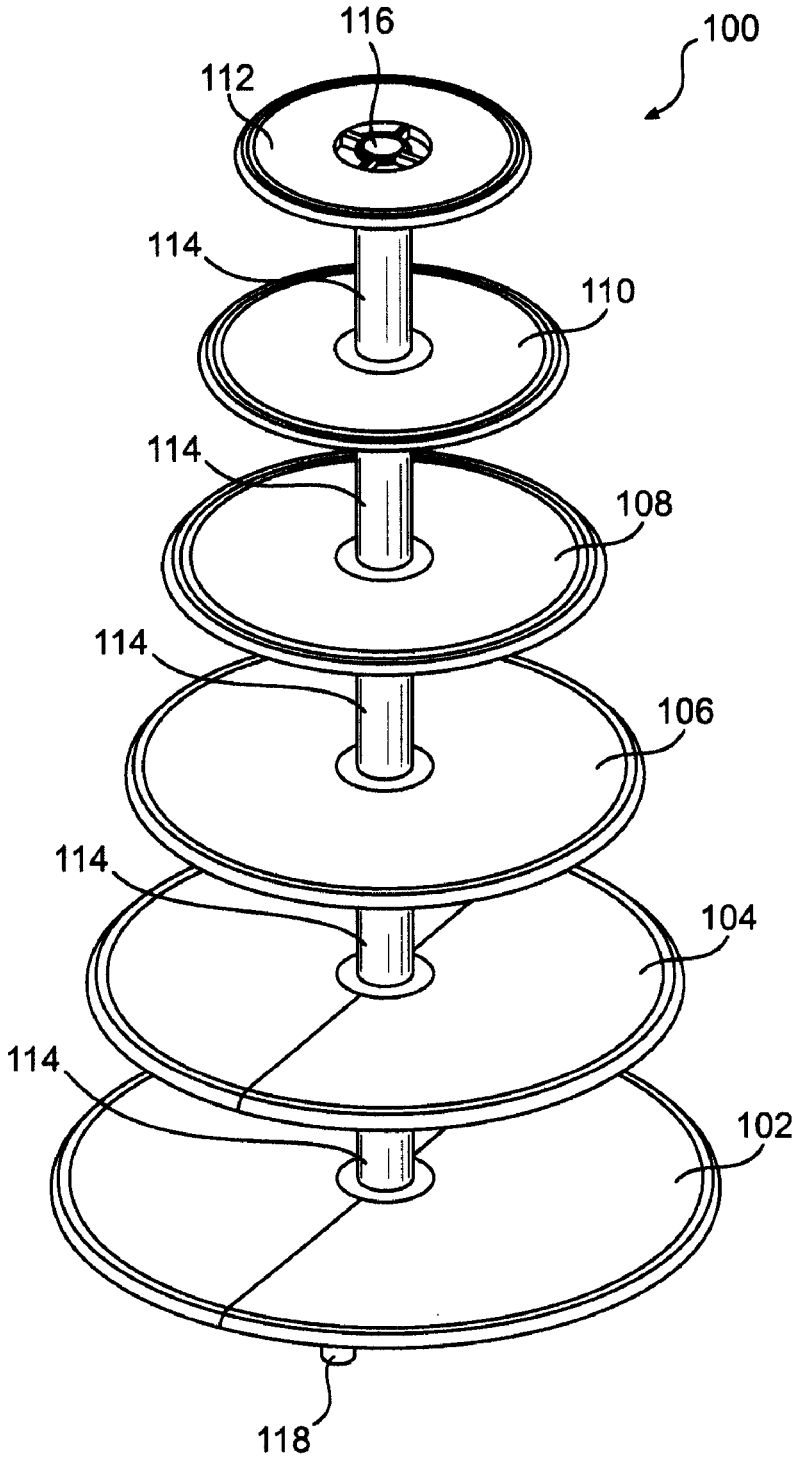
FIG. 1 shows a perspective view of a foodstuffs display stand constructed according to the principles of the invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

FIG. 1 shows a perspective view of a foodstuffs display stand constructed according to the principles of the invention. In particular, FIG. 1 shows a display stand for foodstuffs 100. The display stand for foodstuffs 100 may include a plurality of plates. The display stand for foodstuffs 100 may have any number of plates that may be desired by the user of the display stand for foodstuffs 100. As further shown in FIG. 1, the display stand for foodstuffs 100 may include plates 102, 104, 106, 108, 110 and 112. Additionally, the display stand for foodstuffs 100 may include a plurality of posts 114 to connect the plates 102, 104, 106, 108, 110, 112 in a vertical arrangement. The construction of the plates 102, 104, 106, 108, 110, 112 and posts 114 may be such that the posts 114 and plates 102, 104, 106, 108, 110, 112 may be easily connected and disconnected in order to be customizable and also to allow for a configuration that may be re-arranged for transport or easy compact storage. The connection between posts 114 and plates 102, 104, 106, 108, 110, 112 may be that of a mechanical fastener or the like that provides for easy construction and further easy disassembly for the same. The mechanical fastener also creates a very sturdy construction.

The display stand for foodstuffs 100 may further include feet 118 to raise the display stand for foodstuffs 100 vertically to provide a more attractive configuration for the display of various foodstuffs. Additionally, the display stand for foodstuffs 100 may further include cap 116 on the uppermost plate, such as shown on plate 112 shown in FIG. 1, to provide a more attractive completed assembly of the display stand for foodstuffs 100. In this regard, each plate may include a hole for a post 114 to extend. If a plate is to be attached above a lower plate, a further post 114 may be attached to the portion of the lower post 114 extending through the hole in the lower plate. The upper plate may then be positioned on the further post 114 and the process repeated to achieve the desired vertical arrangement. Finally, the cap 116 will cover the hole of the upper most plate.

Again, it should be noted that the display stand for foodstuffs 100 may include any number of foodstuffs support plates. As shown in FIG. 1, the display stand for foodstuffs 100 includes six plates. However, the construction of the display stand for foodstuffs 100 may be such that more than six plates may be utilized in order to create display stand for foodstuffs 100 or alternatively less than six plates may be used in order to create the display stand for foodstuffs 100. In this regard, even a single plate, such as plate 100 may be utilized as the display stand for foodstuffs 100 with the cap 116 being located on that particular plate 102. Similarly, the display stand for foodstuffs 100 may include two plates with the cap 116 on the uppermost plate. In a similar fashion any number of plates may be used in conjunction with posts 114 and possibly a cap 116 to provide the desired arrangement of plate sizes, number of plates and vertical height of the display stand for foodstuffs 100. Although a varying number of plate sizes is shown in FIG. 1, such as shown by plates 102, 104, 106, 108, 110, 112, any number of plate sizes may be utilized that are bigger, smaller or the same to provide a desired arrangement.

Figure 2:
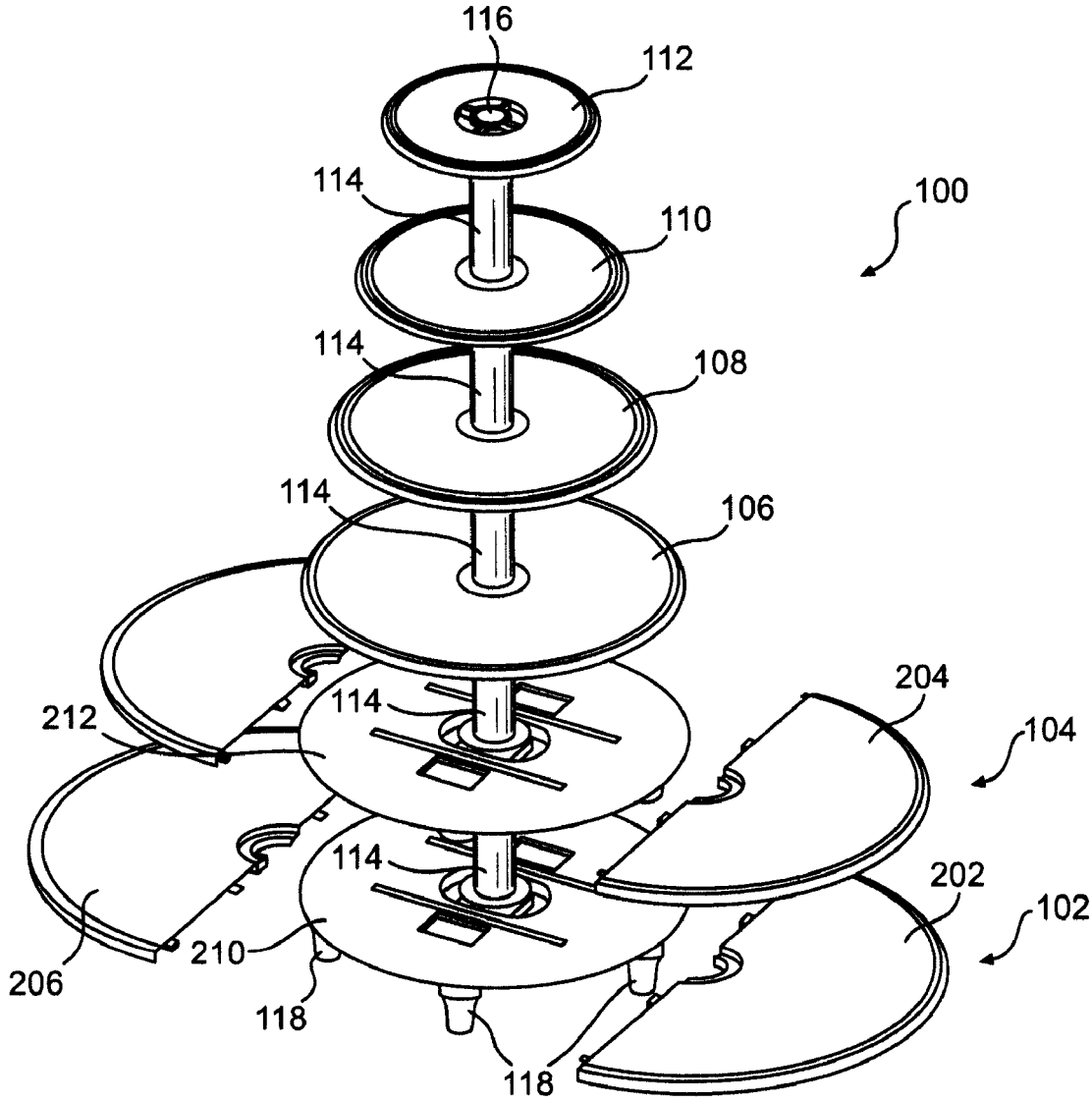
FIG. 2 shows a foodstuffs display stand showing an exploded view of two of the plates constructed according to the principles of the invention.

FIG. 2 shows a foodstuffs display stand showing an exploded view of two of the plates constructed according to the principles of the invention. In particular, FIG. 2 shows an arrangement of the display stand for foodstuffs 100 wherein plates 102, 104 may be configured to be broken down into smaller parts to enhance the ability to store and ship the display stand for foodstuffs 100. More specifically, as shown in FIG. 2, plate 102 may be split into plate portion 202 and plate portion 206. As such, plate 102 split into plate portions 202, 206 may be arranged on a plate portion support 210. In this regard, the bottommost post 114 may be configured to connect to the plate portion support 210 with the plate portions 202, 206 configured to connect and be placed on top of plate support portion 210 to provide a finished look. Further, feet 118 may be connected to plate support portion 210 to again provide stability and possibly further provide a more attractive look for the display stand for foodstuffs 100.

As further shown in FIG. 2, other plates of the foodstuff support stand 100 may also have the ability to be separated and arranged in a configuration that may allow for enhanced storage such as the plate 104 that has plate portions 204, 208. Similarly, plate 104 may include plate support portion 212 that may again allow connection to a support post 114 and connection to the support post 114 below it and also provide a support for plate 104 and, in particular, plate portions 204, 208. As shown in FIG. 2, the plates 104, 102 may be arranged as 18" diameter plates and the plate support portions 210, 212 may be arranged as 16" diameter portions. However, it is contemplated by the invention that any size support plate is contemplated and any size plate support portion is further contemplated. Further, although round plates are shown and described herein, other shapes are also contemplated. These shapes include square, rectangular, polygonal, the like.

Figure 3:
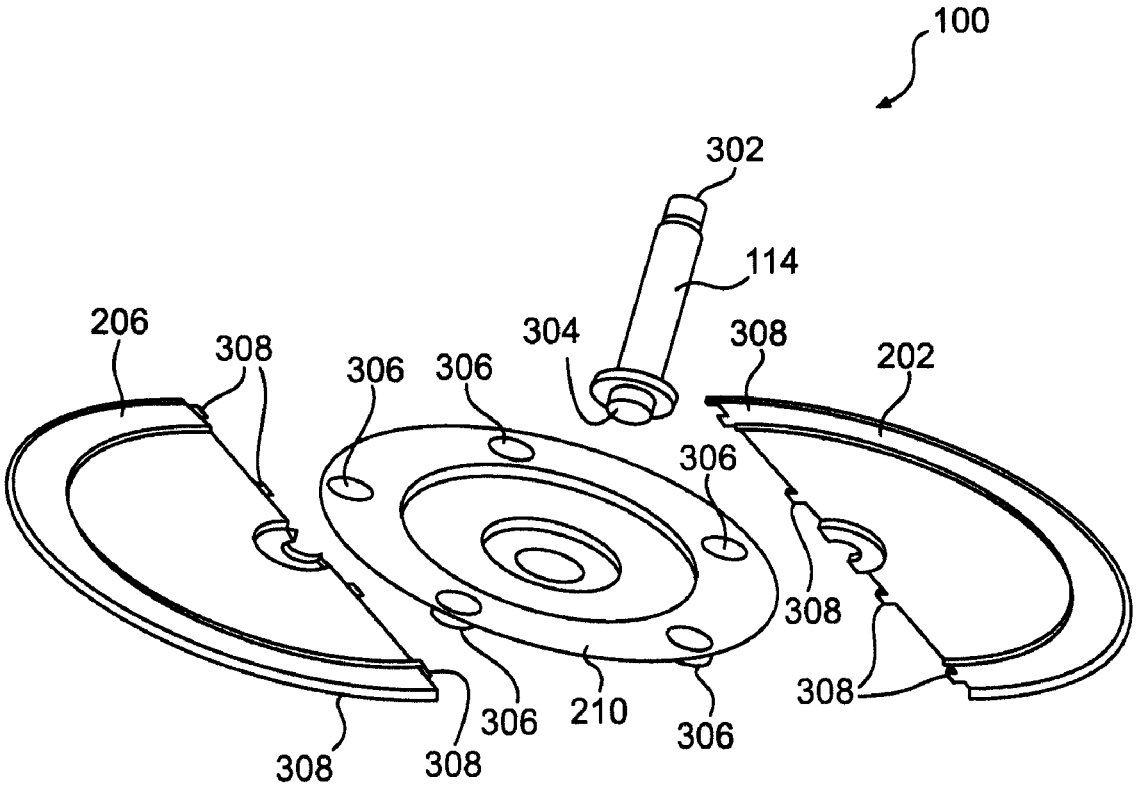
FIG. 3 shows an exploded bottom view of one of the display plates and a support post constructed according to the principles of the invention.

FIG. 3 shows an exploded bottom view of one of the display plates and a support post constructed according to the principles of the invention. In particular, FIG. 3 shows the plate portion 202 and plate portion 206. Plate portions 202, 206 may include reinforcing rib structure as shown in FIG. 3. Moreover, plate support portion 210 may also include molded rib reinforcement structure along the bottom thereof to increase the rigidity and strength of the same. The plate support portion 210 may also include threaded apertures 306. The threaded apertures 306 may allow for connection of feet 118 thereto as described in further detail below. The post 114 also includes threaded portion 304. The threaded portion 304 of post 114 mechanically fastens to a corresponding threaded portion on top of plate support portion 210 to provide a mechanical connection thereto. Post 114 further includes an upper threaded portion 302 which may allow for a mechanical connection to a support plate portion, a plate there above and/or a post 114 arranged above. Although the threaded apertures 306 and post 114 show a particular mechanical fastener, in this regard, a threaded connection, other types of mechanical connections are contemplated by the invention herein. The plate portions 202, 206 may further include mechanical fasteners 308, along the connection edge thereof. These mechanical connections 308 interact with one another to lock plate portion 202 and plate portion 206 together to provide a firmly connected plate 102. The mechanical connections 308 may be, for example, elastic hook connections that interact with one another to provide a locking arrangement. Of course other types of mechanical connectors and no mechanical connector at all is further contemplated by the invention.

Figure 4:
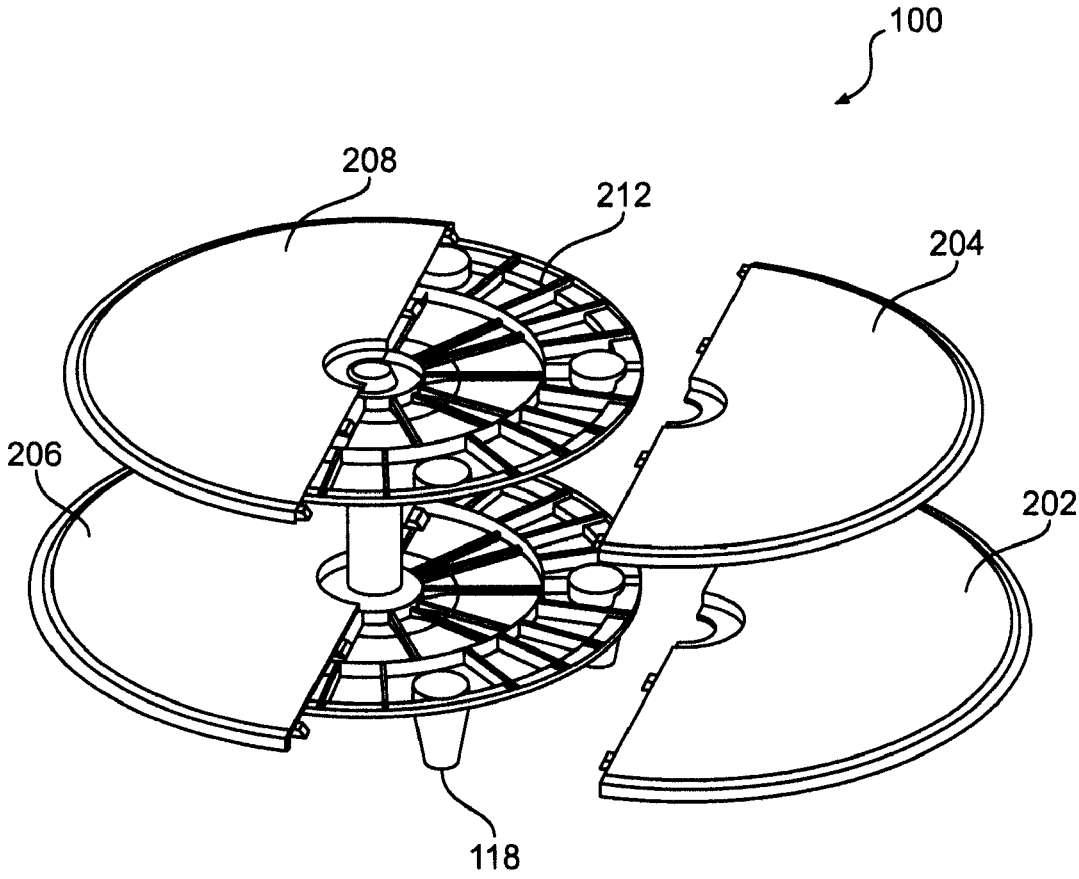
FIG. 4 shows another view of the display stand showing a partial exploded view of two of the display plates constructed according to the principles of the invention.
Figure 5:
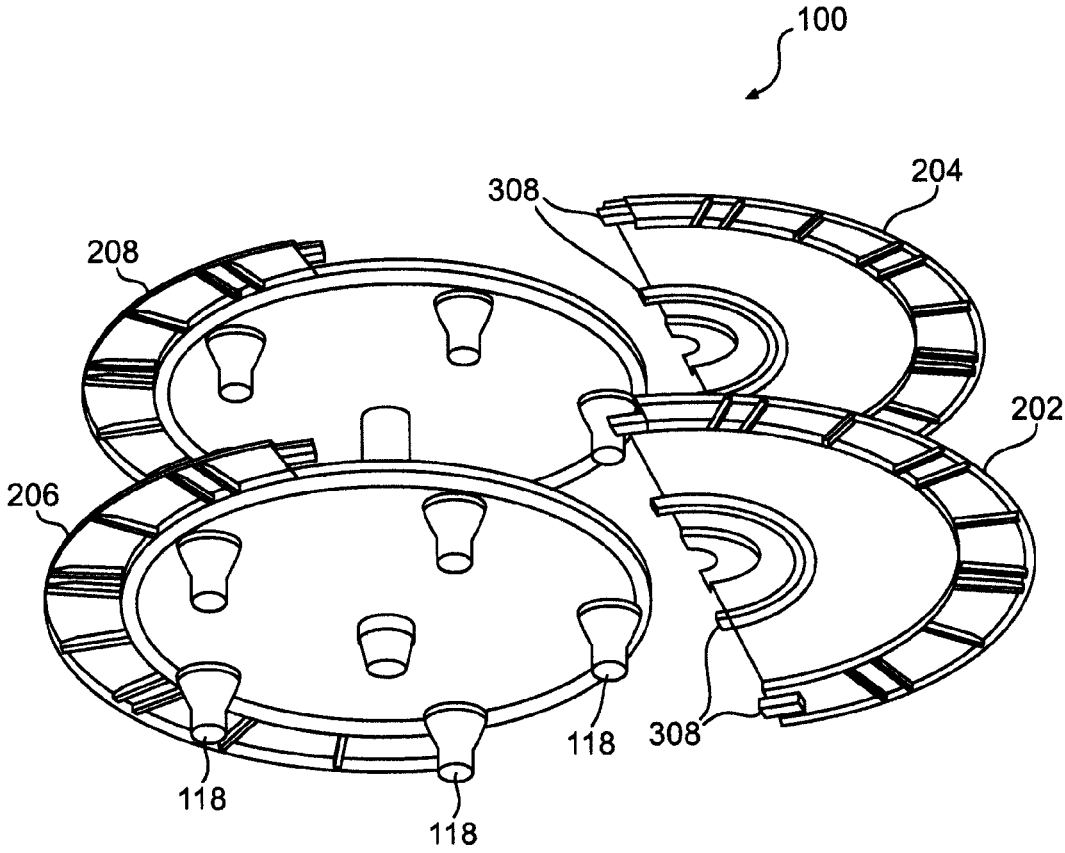
FIG. 5 shows a bottom view of the display stand with a partially exploded view of two of the display plates constructed according to the principles of the invention.

FIG. 4 shows another view of the display stand showing a partial exploded view of two of the display plates constructed according to the principles of the invention; and FIG. 5 shows a bottom view of the display stand with a partially exploded view of two of the display plates constructed according to the principles of the invention. In particular, FIGS. 4 and 5 show plate portions 202, 204 in the partially assembled arrangement. That is plate portions 206, 208 have been positioned on plate portion support 210, 212 and the user merely needs to now extend horizontally plate portions 204, 202 to connect to plate portions 206, 208 respectively. It should be noted that plate portion support 212 may also include apertures 306, to allow for the connection to feet 118. But a user does not necessarily need to use feet 118 when the plate support portion 212 is not on the bottommost level of the foodstuff support stand 100. Of course a user does not need to include feet 118 in the display stand for foodstuffs 100 whatsoever, but they are shown in FIG. 4.

Figure 6:
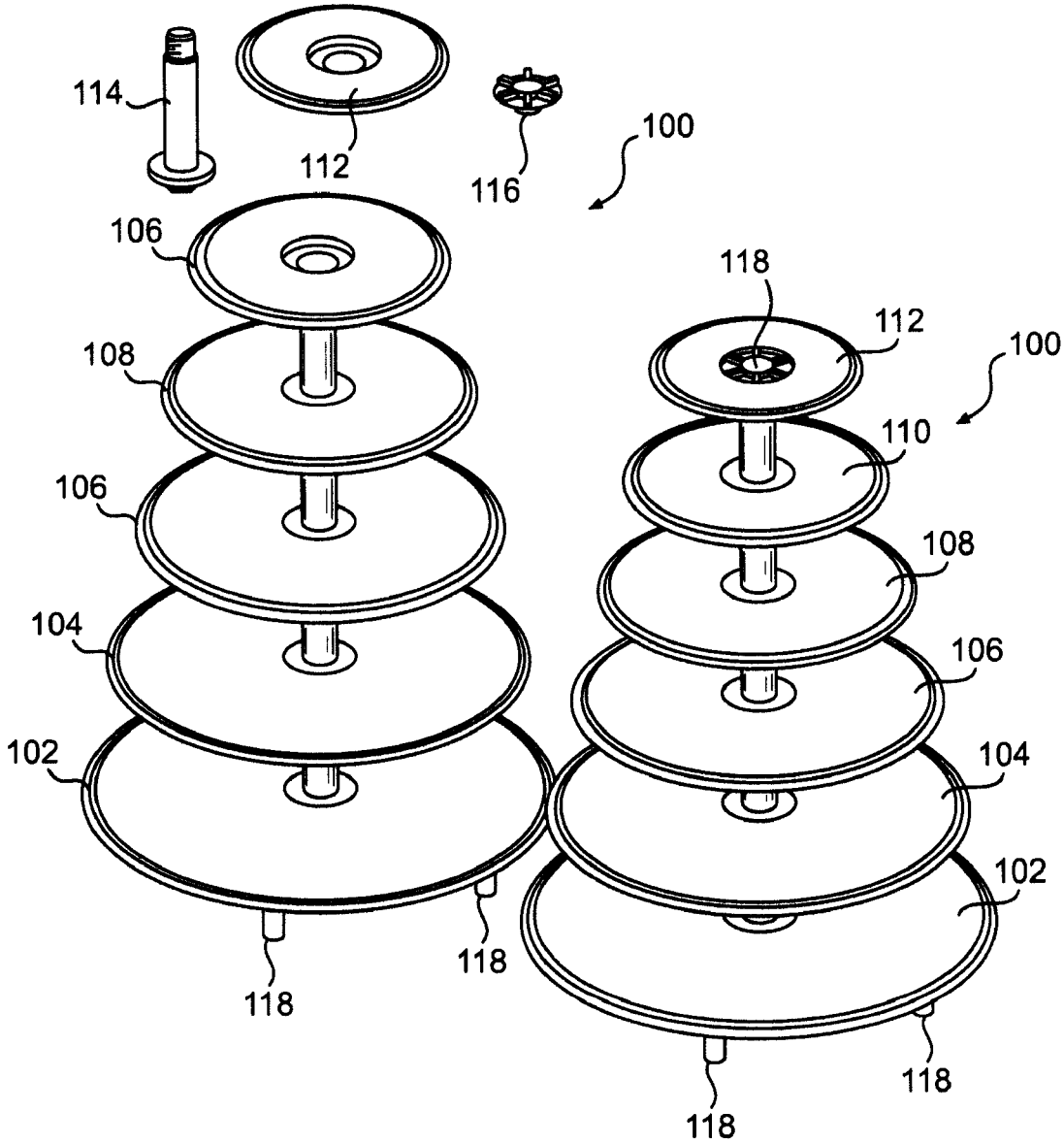
FIG. 6 shows a perspective view of a display stand and another display stand showing a partially exploded view of the uppermost plate constructed according to the principles of the invention.
Figure 7:
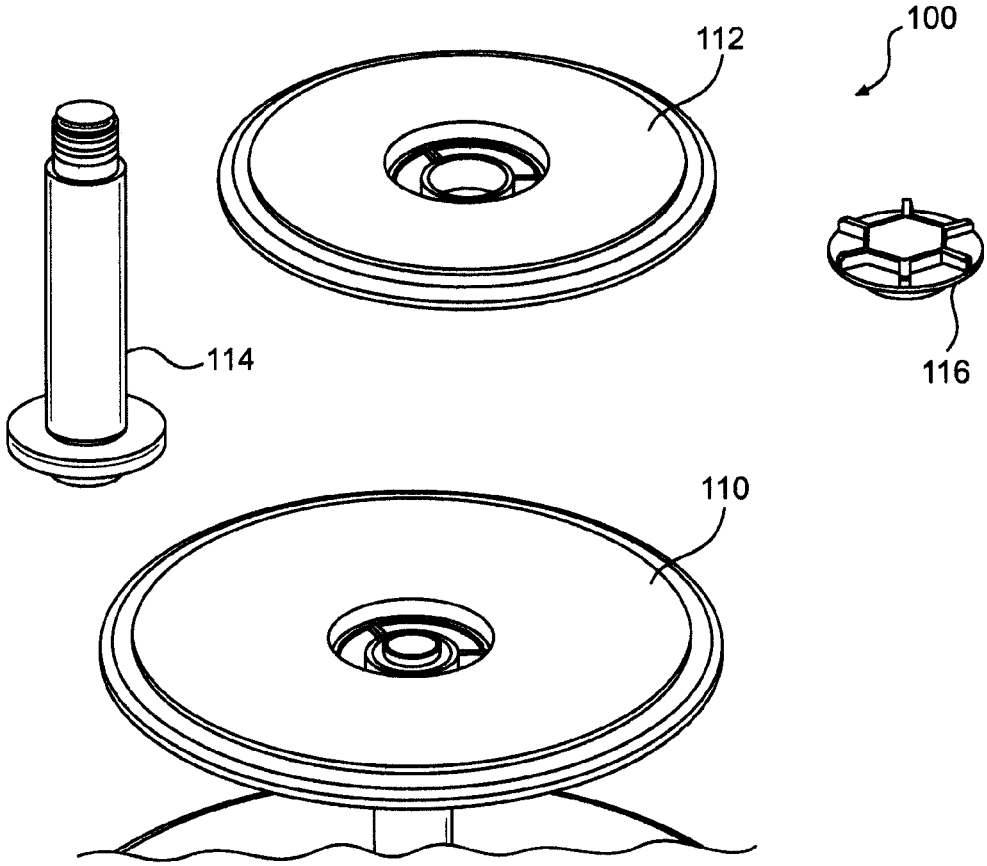
FIG. 7 shows a partial view of a partially exploded display stand constructed according to the principles of the invention.

FIG. 6 shows a perspective view of a display stand and another display stand showing a partially exploded view of the uppermost plate constructed according to the principles of the invention; and FIG. 7 shows a partial view of a partially exploded display stand constructed according to the principles of the invention. FIG. 6 in particular shows a completed foodstuffs support stand 100 (right side) and a partially assembled display stand for foodstuffs 100 (left side also shown in FIG. 7). As further shown in FIG. 6, a user may take a post 114 and mechanically attach it to the current uppermost support plate 110 and thereafter attach a further plate 112 on top of the post 114. Thereafter the user may then attach the cap 116 on top of plate 112 to cover the opening and provide a more attractive finished look as shown by display stand for foodstuffs 100 as shown on the right.

Figure 8:
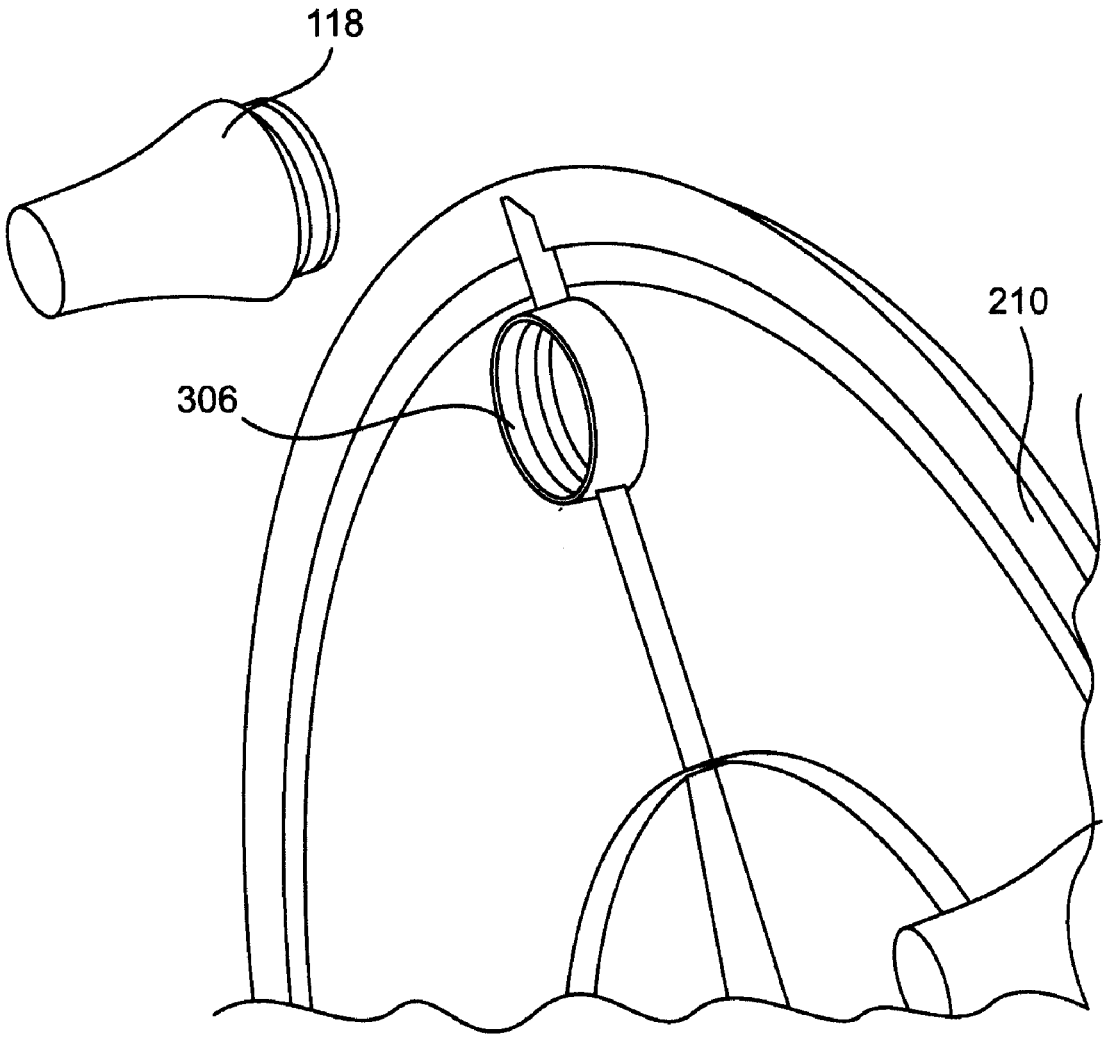
FIG. 8 shows a partial bottom view of the display stand showing a partially exploded view with respect to a leg of the display stand constructed according to the principles of the invention.

FIG. 8 shows a partial bottom view of the display stand showing a partially exploded view with respect to a leg of the display stand constructed according to the principles of the invention. In particular, FIG. 8 shows the arrangement of foot 118 prior to installation to the plate support portion 210 and, in particular, to the threaded aperture 306. Again, it should be noted that any type of mechanical fastener is contemplated for the foot 118 to the plate support portion 210 connection.

Figure 9:
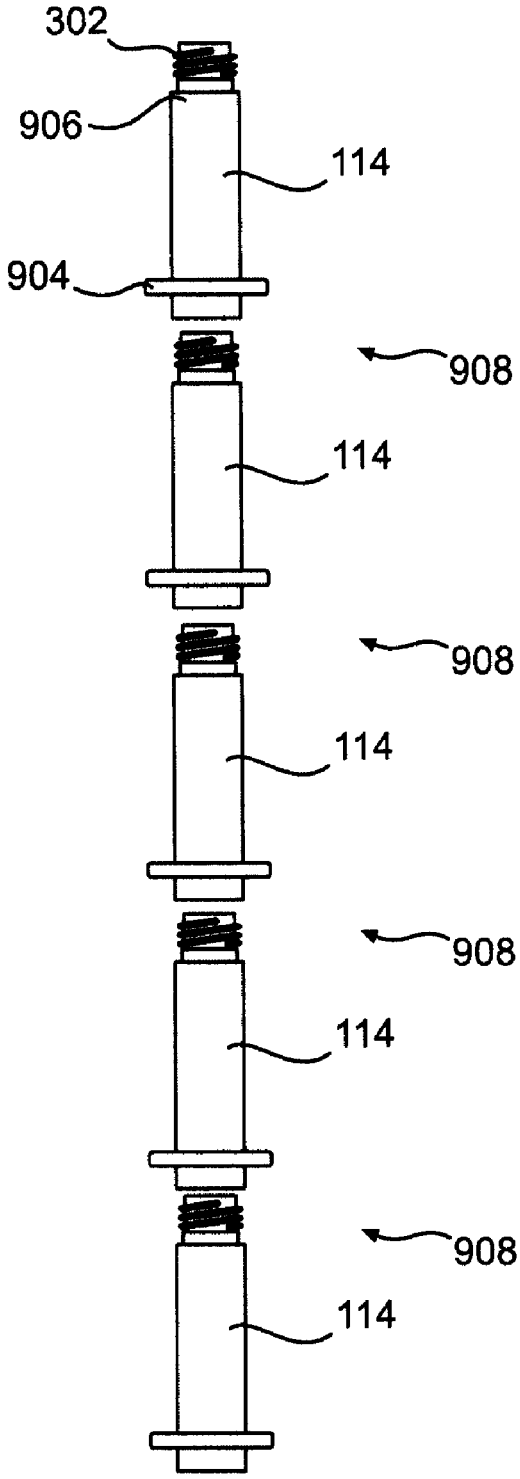
FIG. 9 shows an exploded view of the post arrangement of the display stand constructed according to the principles of the invention.
Figure 10:
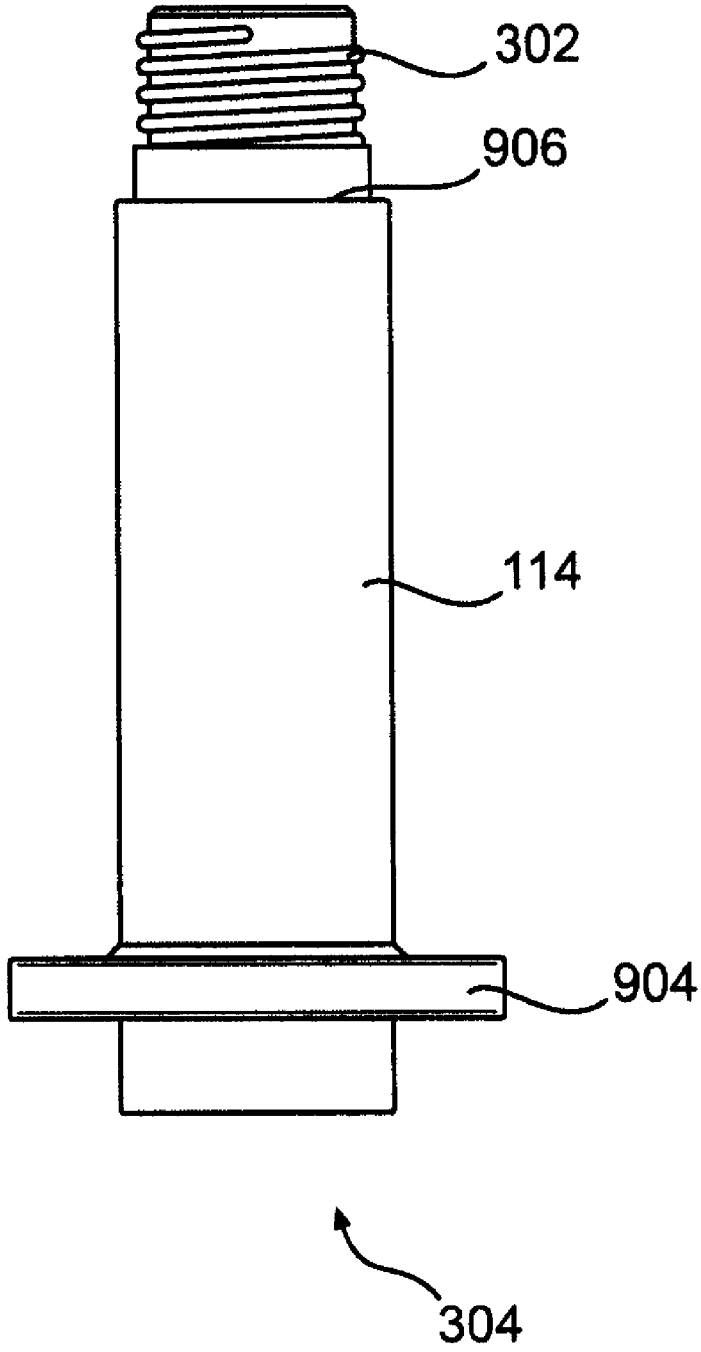
FIG. 10 shows a post of the display stand constructed according to the principles of the invention.

FIG. 9 shows an exploded view of the post arrangement of the display stand constructed according to the principles of the invention; and FIG. 10 shows a post of the display stand constructed according to the principles of the invention. In particular FIGS. 9 and 10 show details of post(s) 114. FIG. 9 shows a stack of posts 114 prior to the posts being mechanically connected. Each post may include a threaded portion 302 and a threaded aperture 304. The threaded aperture 304 may mechanically connect to the threaded portion 302 of a lower post. Alternatively, the threaded connection 304 may threadingly connect to a lowermost plate, such as a plate support 210. The various support plates whether they include a plate support portion 210, 212 or are arranged singularly as shown in FIG. 2 as plates 106, 108, 110, 112 may rest on the flange 906 of a particular post 114. Additionally the post 114 may include an extension 904 that may rest on top of a respective plate 106, 108, 110, 112 or a respective plate support portion 210, 212. In this regard, two posts may sandwich and hold firmly a particular plate or plate portion support at an intersection 908 of posts to create a sturdy construction.

It should be further noted that support post 114 may come in varying heights. Accordingly, a user may desire to have a taller foodstuffs stand and may choose to use a taller post 114 to provide greater distance between respective plates. Additionally, a user may combine more than one post between plates in order to provide a greater distance for taller cakes or a more attractive look. In this regard, the foodstuffs stand 100 may have highly customizable configurations. Any shape or size plate and any number of posts or any size posts may be easily and quickly connected and customized with the desired number of plates, number of posts, number of post heights, plate sizes and the like to provide a highly customizable arrangement for use in displaying foodstuffs.

Although the invention is generally directed to the display of any types of foodstuffs, it is particularly designed for use with cakes and cupcakes. Nevertheless any type of foodstuff may be arranged on the display stand for foodstuffs 100 including hor d'oeuvres, candies, deserts, and the like. Moreover, the foodstuffs stand 100 may be used for non-food products and such is fully contemplated by the invention herein.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed:

1. A multiple tier center support stand comprising:

a plurality of plates each being configured to be associated with a mechanical fastener; and a plurality of posts each being configured to be associated with the mechanical fastener, each of the plurality of posts having an aperture at one end and an extending portion at the other end engageable with an aperture of another of the plurality of posts, a mechanical fastener arranged on at least one of said plurality of plates and said plurality of posts in order to vertically arrange said plurality of plates and said plurality of posts, at least one of the plurality of plates comprising a first plate portion having a first plate portion mechanical fastener and a second plate portion having a second plate portion mechanical fastener, the first plate portion mechanical fastener engagable with second plate portion mechanical fasteners for removably securing the first plate portion to the second plate portion, a plate support portion for supporting the at least one of the plurality of plates, the first plate portion and the second plate portion connectable with the plate support portion, the at least one of the plurality of plates being larger than the plate support portion, wherein the plate support portion has a circumference less than a circumference of the at least one of the plurality of plates, and wherein at least one of the plurality of plates is configured to be disassembled in at least two pieces.

2. The multiple tier center support stand according to claim 1 wherein the aperture includes internal threading engageable with external threading of the extending portion.

3. The multiple tier center support stand according to claim 1 further comprising each of the plurality of posts having a flange and an extension.

4. The multiple tier center support stand according to claim 3, wherein the flange supports one of the plurality of plates and the extension positioned above the one of the plurality of plates to retain the one of the plurality of plates.

5. The multiple tier center support stand according to claim 1 further comprising a cap to cover a hole in an uppermost plate of the plurality of plates.

6. The multiple tier center support stand according to claim 1 further comprising feet configured to be arranged under a lowermost plate of the plurality of plates.

7. The multiple tier center support stand according to claim 6 wherein the feet and the lowermost plate further comprise mechanical fasteners to allow for connection there-between.

8. The multiple tier center support stand according to claim 1 wherein the plurality of plates comprise one of a round, square, rectangular, and polygonal shape.

9. The multiple tier center support stand according to claim 1 wherein the posts are configured to mechanically fasten to one another and accordingly sandwich one of the plurality of plates therebetween.

10. A multiple tier center support stand comprising:

a plurality of plates each being configured with an aperture to interact with a mechanical fastener; and a plurality of posts each being configured to be associated with the mechanical fastener, a mechanical fastener arranged on at least one of said plurality of plates and said plurality of posts in order to vertically arrange said plurality of plates and said plurality of posts, the plurality of plates comprising a lowermost plate and an uppermost plate and the plurality of posts comprising a lowermost post and an uppermost post associated, respectively, with the lowermost plate and the uppermost plate, the lowermost plate comprising a first plate portion having a first plate portion mechanical fastener and a second plate portion having a second plate portion mechanical fastener, the first plate portion mechanical fastener engagable with second plate portion mechanical fasteners for removably securing the first plate portion to the second plate portion, a plate support portion for supporting the lowermost plate, the first plate portion and the second plate portion connectable with the plate support portion, the lowermost post having an aperture for receiving a foot; and a cap engagable with an extending portion of the uppermost post, the cap securing the uppermost plate to the uppermost post, wherein at least one of the plurality of plates is configured to be disassembled in at least two pieces.

11. The multiple tier center support stand according to claim 10 wherein the aperture includes internal threading engageable with external threading of the extending portion.

12. The multiple tier center support stand according to claim 10 further comprising each of the plurality of posts having a flange and an extension.

13. The multiple tier center support stand according to claim 10 further comprising a cap to cover a hole in the uppermost plate.

14. The multiple tier center support stand according to claim 10 further comprising feet configured to be arranged under the lowermost plate.

15. The multiple tier center support stand according to claim 14 wherein the feet and the lowermost plate further comprise mechanical fasteners to allow for connection therebetween.

16. The multiple tier center support stand according to claim 10 wherein the plates comprise one of a round, square, rectangular, and polygonal shape.

17. The multiple tier center support stand according to claim 10 wherein the posts are configured to mechanically fasten to one another and accordingly sandwich a respective said plate therebetween.

* * * * *